US009828875B2

(12) United States Patent
Meyer et al.

(10) Patent No.: US 9,828,875 B2
(45) Date of Patent: Nov. 28, 2017

(54) TURBOMACHINE WITH GAP ADJUSTMENT

(71) Applicant: SIEMENS AKTIENGESELLSCHAFT, München (DE)

(72) Inventors: Marcus Meyer, Duisburg (DE); Dieter Naβ, Moers (DE); Werner Schedlinski, Duisburg (DE); Heiko Thielhorn, Duisburgh (DE)

(73) Assignee: SIEMENS AKTIENGESELLSCHAFT (DE)

( * ) Notice: Subject to any disclaimer, the term of this patent is extended or adjusted under 35 U.S.C. 154(b) by 384 days.

(21) Appl. No.: 14/378,717

(22) PCT Filed: Feb. 15, 2013

(86) PCT No.: PCT/EP2013/053096

§ 371 (c)(1),
(2) Date: Aug. 14, 2014

(87) PCT Pub. No.: WO2013/121008

PCT Pub. Date: Aug. 22, 2013

(65) Prior Publication Data

US 2015/0030444 A1 Jan. 29, 2015

(30) Foreign Application Priority Data

Feb. 17, 2012 (DE) ..... 10 2012 202 468

(51) Int. Cl.
*F01D 25/24* (2006.01)
*F04D 17/12* (2006.01)
(Continued)

(52) U.S. Cl.
CPC ..... *F01D 25/24* (2013.01); *F01D 25/246* (2013.01); *F04D 17/122* (2013.01); *F04D 29/4206* (2013.01); *F04D 29/624* (2013.01)

(58) Field of Classification Search
CPC ..... F01D 25/246; F01D 25/285
(Continued)

(56) References Cited

U.S. PATENT DOCUMENTS 2,034,076 A * 3/1936 Zahner ..... E21C 37/04 254/104
3,089,680 A 5/1963 Deve
(Continued)

FOREIGN PATENT DOCUMENTS

CN 1378036 A 11/2002
CN 101983280 A 3/2011
(Continued)

OTHER PUBLICATIONS

International Search Report for PCT Application No. PCT/EP2013/053096, dated Jun. 20, 2014.
(Continued)

*Primary Examiner* — Craig Kim
*Assistant Examiner* — Jason Mikus
(74) *Attorney, Agent, or Firm* — Schmeiser Olsen & Watts LLP

(57) ABSTRACT

A turbomachine, in particular, a compressor, having a housing and having at least one housing insert accommodated therein and having a fitting piece for the adjustment of a gap dimension between the housing and the housing insert, wherein the housing comprises, for the adjustment of the gap dimension, a horizontally adjustable guide element into which the fitting piece is inserted, is provided.

4 Claims, 2 Drawing Sheets

(51) Int. Cl.
*F04D 29/42* (2006.01)
*F04D 29/62* (2006.01)

(58) Field of Classification Search
USPC ..... 415/126, 127, 209.2; 403/318, 319
See application file for complete search history.

(56) References Cited

U.S. PATENT DOCUMENTS 3,169,748 A * 2/1965 Howard ..... F01D 25/246 415/209.2
3,892,500 A 7/1975 Miller et al.
3,892,509 A 7/1975 Ruegg
4,380,405 A * 4/1983 Kaneki ..... F04D 29/4206 403/318
5,427,349 A * 6/1995 Obrecht ..... B21D 28/00 248/188.4
5,547,330 A * 8/1996 Walimaa ..... F16M 11/043 269/71
2012/0039709 A1 2/2012 Rauch et al.

FOREIGN PATENT DOCUMENTS

DE 726 510 10/1942
DE 3100039 A1 12/1981
DE 10116319 C1 2/2003
DE 102006012361 A1 10/2006
DE 102007025130 A1 12/2008

OTHER PUBLICATIONS

Translation of first Office Action for corresponding Chinese application No. 201380009897.8, dated May 5, 2015.

* cited by examiner

TURBOMACHINE WITH GAP ADJUSTMENT

CROSS-REFERENCE TO RELATED APPLICATIONS

This application claims priority to PCT Application No. PCT/EP2013/053096, having a filing date of Feb. 15, 2013, based off of DE 102012202468.9 having a filing date of Feb. 17, 2012, the entire contents of which are hereby incorporated by reference.

FIELD OF TECHNOLOGY

The following relates to a turbomachine, in particular, a compressor, having a housing and at least one housing insert received therein and an adjusting piece for adjusting a gap size between the housing and the housing insert.

BACKGROUND

Compressors comprise a housing with a housing insert, which can be inserted, serves as a stator and is also called a return stage. Each rotor of the compressor is usually assigned a return stage. With regard to use at low temperatures or in the case of great temperature differences, return stages can have a three-point mounting. Said three-point mounting is necessary, in order that the components can expand thermally, without causing pressure between the housing and the return stage or other components which are attached in the interior of the housing. The adjusting or centering of a return stage takes place via three mounting points, on which the return stage is mounted. In practice, the radial orientation or adjustment of the return stage via said three points is difficult, however, since the return stage can lie eccentrically with respect to the housing as a result of tolerances. In the case of eccentric mounting of this type, the gap between the return stage and a shaft of the compressor is reduced on one side, with the result that rubbing of the rotor might occur in the worst case. In practice, the radial guidance of the housing insert (return stage) is therefore adapted in a complicated manner if the internal diameter and external diameter are not concentric.

This operation is shown diagrammatically in FIG. 1. FIG. 1 shows a housing 1 of a conventional turbomachine and a housing insert 2 which is received spaced apart therein. The measurement and adaptation are complicated, since a gap s which is measured between the housing 1 and the housing insert 2 has to be transferred to a gap t at the lowest point of the housing insert. It has to be ensured here that the internal diameter lies coaxially with respect to the housing middle or with respect to the bearing center.

The vertical orientation of the housing insert 2 takes place by way of two adjusting pieces in the joint region. The adjusting pieces which are shown using dashed lines in FIG. 1 are connected to the housing insert 2 and are adapted; a gap is situated to the side thereof. A further adjusting piece which assumes the horizontal guidance is used on the underside. In order to adapt said adjusting piece laterally, it is necessary to remove the housing insert 2 from the turbomachine, possibly several times. A gap is situated below the said adjusting piece, in order to make a vertical movement of the housing insert 2 possible.

SUMMARY

An aspect relates to a turbomachine, in which the adjustment of the housing insert is simplified.

A turbomachine of the type mentioned at the outset has a housing that comprises a horizontally adjustable guide element with a recess for adjusting the gap size, into which recess the adjusting piece which is connected to the housing insert is inserted.

The turbomachine according to embodiments of the invention has the advantage that the complicated adaptation of an adjusting piece can be dispensed with, since the gap size can be brought about by way of a horizontal adjustment of the guide element. The guide element serves to guide the adjusting piece which can be adjusted along an axis as a result, in order to set a defined gap size.

It also lies within the scope of the embodiments of the invention that the guide element has a horizontally running threaded bore which is aligned with a through bore in the housing, with the result that a screw or threaded rod which penetrates the through bore can be screwed in. Accessibility from the outside to the guide element which is arranged adjustably on the housing is made possible by way of the through bore.

A further setting option results if the adjusting piece in the turbomachine according to embodiments of the invention is inserted with axial play into the guide element.

It can be provided within the scope of one development of the embodiments of the invention that the adjusting piece can be connected or is connected to the housing insert by means of a screw connection. In this way, the housing insert is connected fixedly to the adjusting piece, with the result that an adjustment of the housing insert can take place indirectly by way of an adjustment of the adjusting piece by way of adjusting of the guide element.

In the turbomachine according to embodiments of the invention, the recess of the guide element can have an emptying bore which preferably opens into a radial groove between the guide element and a housing rib. A liquid can be discharged from the recess of the guide element through said emptying bore.

BRIEF DESCRIPTION

Some of the embodiments will be described in detail, with reference to the following figures, wherein like designations denote like members, wherein.

DETAILED DESCRIPTION

Figure 1:
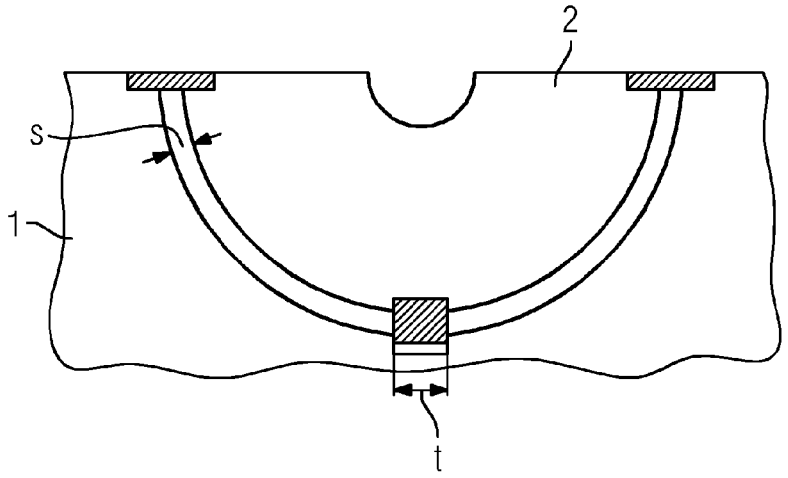
FIG. 1 shows a detail of a conventional turbomachine.
Figure 2:
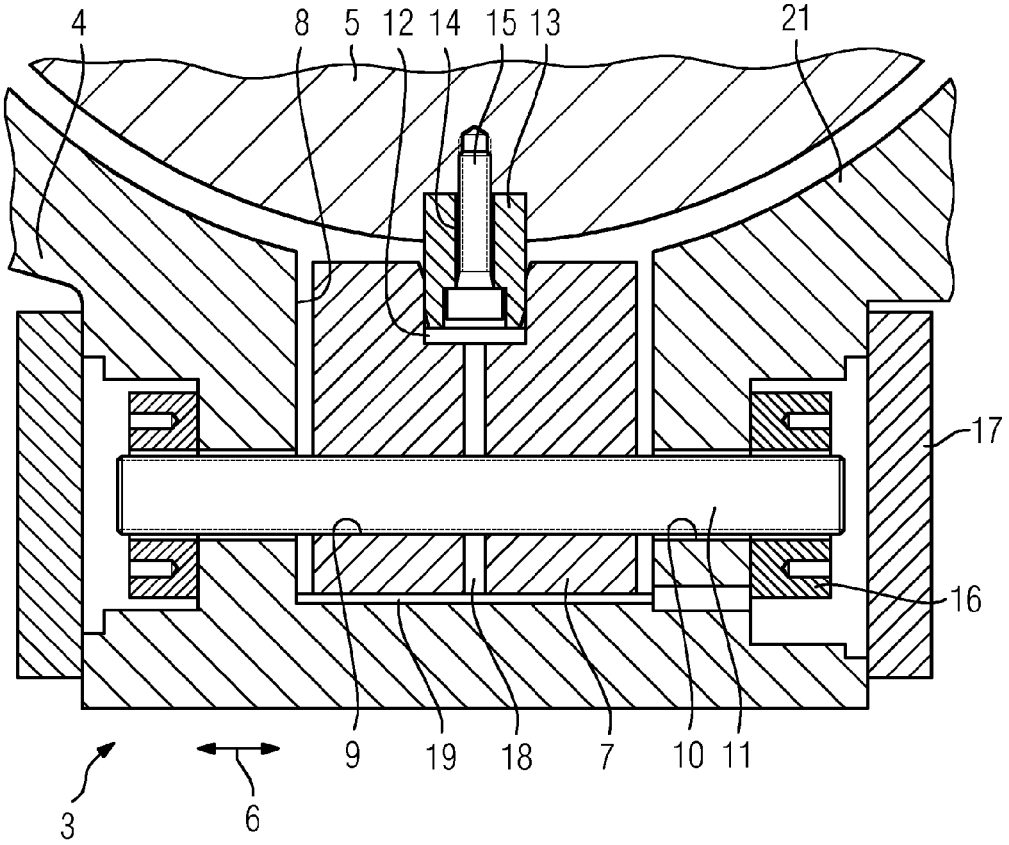
FIG. 2 shows a first exemplary embodiment of a turbomachine according to the invention in a sectioned view.

The turbomachine 3 which is configured as a compressor and is shown in details in a sectioned view in FIG. 2 comprises a housing 4, into which a housing insert (return stage) 5 which is shown merely partially is inserted. The housing insert 5 has the function of a stator and serves to deflect a flow in the housing 4 of the turbomachine 3. In order for it to be possible to adjust the housing insert 5 in the horizontal direction which is identified by way of a double arrow 6, a guide element 7 is provided which is arranged in a recess 8 of the housing 4. By way of orientation of the return stage 5, an adjusting piece 13 which is mounted in a return stage 5 fixes the position. During the insertion of the return stage 5, the guide element 7 is oriented in accordance with the position of the return stage 5. Subsequently, the fixing is effected by way of a threaded rod 11 and nuts 16.

As is shown in FIG. 2, the guide element 7 has a threaded bore 9 which runs in the horizontal direction and is aligned with a through bore 10 in the housing 4. The threaded rod 11 penetrates the through bore 10 and is in engagement with the threaded bore 9, with the result that the position of the guide element 7 can be fixed by way of the threaded rod 11. The threaded rod 11 is screwed in until the projecting lengths on both sides are identical; the threaded rod 11 is held by way of the nuts 16, in each case one shim being used, with the result that a play-free connection is produced.

On its side which points into the housing interior, the guide element 7 has a recess 12, into which the adjusting piece 13 is inserted in an axially movable manner. The adjusting piece 13 has a through bore 14; the housing insert 5 is screwed to the adjusting piece 13 by means of a screw 15 which is inserted into the through bore 14. The axial fixing of the housing insert 5 is effected by way of a circumferential feather key.

After the adjustment of the guide element 7, the threaded rod 11 is screwed at its two ends by way of nuts 16. The nuts 16 are covered in each case by way of flanges 17.

It can be seen in FIG. 2 that the guide element 7 is offset to the outside in comparison with the housing 4, away from the housing insert 5; accordingly, a greater gap is formed between the guide element 7 and the housing insert 5 than between the housing 4 and the housing insert 5.

The guide element 7 has an emptying bore 18 which is connected to the recess and is arranged approximately in the center of the guide element 7. The emptying bore 18 opens into a radial groove 19, from where a fluid to be discharged can be drained off to the outside.

The turbomachine 3 which is shown partially in FIG. 2 has the advantage that a radial adjustment or orientation of the housing insert 5 is possible by means of the guide element 7 which is subsequently fixed on the housing 21, with the result that complicated and awkward adaptation of the adjusting piece 13 is dispensed with.

Figure 3:
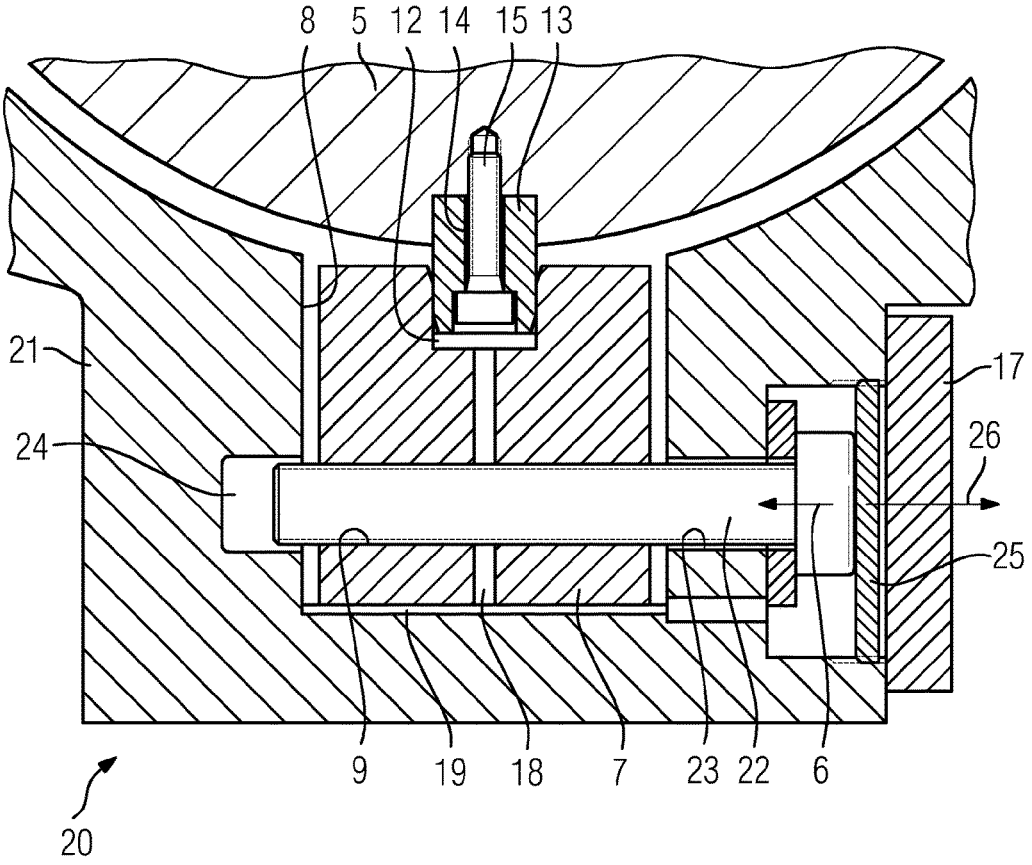
FIG. 3 shows a second exemplary embodiment of a turbomachine in a sectioned view.

FIG. 3 shows a second exemplary embodiment of a turbomachine 20 which is of similar construction to the turbomachine 3 which is shown in FIG. 2. A detailed description of corresponding components is therefore dispensed with at this point. The same designations are used for corresponding components.

In conformity with the first exemplary embodiment, a guide element 7 is arranged horizontally adjustably in a recess 8 of a housing 21. The adjusting piece 13 which is screwed to the housing insert 5 is arranged in the recess 12 of the guide element 7.

In order to fix the gap between the housing insert 5 and the housing 21 after the adjustment, a screw 22 is provided which is screwed into the threaded bolt 9 of the guide element 7. The screw 22 penetrates a through bore 23 in the housing 21 and opens into a blind bore 24. After the gap size between the return stage 5 and the housing 21 has been set, the screw 22 is screwed in in order to fix the position of the guide element 7; the screw is fixed by way of a threaded washer 25 which bears against the screw head. The head of the screw absorbs forces in the direction of the arrow 6; the threaded washer 25 prevents movements in the other direction, which is shown by way of the opposite arrow 26.

Unlike in the conventional procedure for gap adaptation, in which the adjusting piece is ground in a complicated manner, it is not necessary to remove the housing insert 5 in the turbomachine 20 which is shown in details in FIG. 3. The required mounting time is shortened considerably as a result of the position which can be fixed by means of the screw 22.

Although the invention has been illustrated and described in greater detail by the preferred exemplary embodiment, the invention is not restricted by the disclosed examples, and a person skilled in the art can derive different variations herefrom, without departing from the scope of protection of the invention.

The invention claimed is:

1. A turbomachine having a housing with a radius and at least one housing insert having a radius, said radius of said housing insert received in the radius of the housing and an adjusting piece for adjusting a gap size between the housing and the at least one housing insert, wherein, in order to adjust the gap size, the housing comprises a guide element that is adjusted horizontally within a recess of the housing, and into which the adjusting piece is inserted which is connected fixedly to the at least one housing insert by a screw connection, the guide element having a horizontally running threaded bore which is aligned with a through bore in the housing, a screw or threaded rod which penetrates the through bore being screwed into the threaded bore in order to fix the gap size.

2. The turbomachine as claimed in claim 1, wherein the adjusting piece is inserted with axial play into the guide element.

3. The turbomachine as claimed in claim 1, wherein the guide element has an axial emptying bore.

4. The turbomachine as claimed in claim 1, further comprising nuts secured to the threaded rod for fixing the gap size.

* * * * *